US008328596B2

(12) United States Patent
Payne

(10) Patent No.: US 8,328,596 B2
(45) **Date of Patent: *Dec. 11, 2012**

(54) POP-UP PLAY SET

(75) Inventor: Julian R. Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/086,317

(22) Filed: Apr. 13, 2011

(65) Prior Publication Data

US 2011/0217901 A1 Sep. 8, 2011

Related U.S. Application Data

(63) Continuation of application No. 12/131,838, filed on Jun. 2, 2008, now Pat. No. 7,927,176.

(60) Provisional application No. 60/933,085, filed on Jun. 2, 2007.

(51) Int. Cl.
*A63H 33/00* (2006.01)

(52) U.S. Cl. ..... 446/478; 446/71; 446/72; 446/73; 446/74; 446/75; 446/76; 446/487; 273/236; D21/509; D21/510

(58) Field of Classification Search ..... 446/71–76, 446/478, 487; 273/236; D21/509, 510
See application file for complete search history.

(56) References Cited

U.S. PATENT DOCUMENTS

| | | | |
|---|---|---|---|
| 1,258,788 | A | 3/1918 | Koch |
| 1,914,116 | A | 6/1933 | Ford |
| 2,198,306 | A | 2/1939 | Fisher |
| 2,872,753 | A | 2/1959 | Fenton |
| 2,992,598 | A | 7/1961 | Einfalt |
| 3,108,398 | A | 10/1963 | Einfalt |
| RE26,642 | E | 8/1969 | Bender |
| 4,030,234 | A | 6/1977 | Allen et al. |
| 4,030,235 | A | 6/1977 | Terzian et al. |
| 4,067,137 | A | 1/1978 | Korthase |

(Continued)

FOREIGN PATENT DOCUMENTS

| | | | |
|---|---|---|---|
| GB | 2159721 | A | 12/1985 |

(Continued)

OTHER PUBLICATIONS

International Search Report dated Dec. 23, 2008 for PCT/US2008/065572; International Filing Date Jun. 2, 2008.

(Continued)

*Primary Examiner* — Gene Kim
*Assistant Examiner* — Alexander Niconovich
(74) *Attorney, Agent, or Firm* — Cantor Colburn LLP

(57) ABSTRACT

A play set having a main panel section and a pair of side panel sections, each of which is pivotably connected to tile side lateral edges of the main panel section. When the play set is in a first orientation, the main panel section and the pair of side panel sections are oriented generally co-planar to each other such that the upper main surface and upper side surfaces define a play surface having a perimeter, and when the play set is in a second orientation, the side panel sections are adjacent each other and in a plane parallel to the main panel section to define a play set case. When in the first orientation, one of the panel sections includes an elongated member extendable therefrom in a telescoping manner to define an additional play surface outside the perimeter of the main panel sections and side panel sections.

9 Claims, 12 Drawing Sheets

U.S. PATENT DOCUMENTS

| | | | |
|---|---|---|---|
| 4,139,967 | A | 2/1979 | Kuna et al. |
| 4,161,081 | A | 7/1979 | Katzman et al. |
| 4,165,579 | A | 8/1979 | Chase |
| 4,194,318 | A | 3/1980 | Watanabe |
| 4,285,157 | A | 8/1981 | Lambert |
| 4,349,983 | A | 9/1982 | Kilroy et al. |
| D267,570 | S | 1/1983 | Argandona |
| D269,360 | S | 6/1983 | Ng |
| 4,433,504 | A | 2/1984 | Terui |
| 4,516,948 | A | 5/1985 | Obara |
| 4,536,162 | A | 8/1985 | Ace, Jr. et al. |
| 4,558,867 | A | 12/1985 | Hippely |
| 4,755,159 | A | 7/1988 | Templeton et al. |
| 4,883,443 | A | 11/1989 | Chase |
| 4,898,404 | A | 2/1990 | Babcock |
| 4,937,207 | A | 6/1990 | Simmell et al. |
| 4,946,413 | A | 8/1990 | Lehmann et al. |
| 4,961,716 | A | 10/1990 | Hippely et al. |
| 5,004,445 | A | 4/1991 | Coleman et al. |
| 5,013,278 | A | 5/1991 | Dixon et al. |
| 5,085,608 | A | 2/1992 | Turner |
| 5,098,327 | A | 3/1992 | Ferrero |
| 5,480,335 | A | 1/1996 | Caveza |
| 5,542,870 | A | 8/1996 | Westersund |
| 5,562,520 | A | 10/1996 | Pridonoff et al. |
| D394,476 | S | 5/1998 | Blumenthal |
| 5,820,436 | A | 10/1998 | Pohlman |
| 5,839,937 | A | 11/1998 | Thomas |
| 5,931,099 | A | 8/1999 | Bruner et al. |
| 5,961,149 | A | 10/1999 | Hunt |
| 5,971,833 | A | 10/1999 | Rasmussen et al. |
| 6,056,623 | A | 5/2000 | Arriola |
| 6,066,022 | A | 5/2000 | Fobean et al. |
| 6,099,380 | A | 8/2000 | Rasmussen |
| 6,146,238 | A | 11/2000 | Daiber |
| 6,203,017 | B1 | 3/2001 | Schultz |
| 6,508,179 | B2 | 1/2003 | Annis et al. |
| 6,554,685 | B2 | 4/2003 | Lish |
| 6,572,436 | B1 | 6/2003 | So |
| 6,663,464 | B2 | 12/2003 | Payne et al. |
| 6,783,419 | B1 | 8/2004 | Paukert et al. |
| 6,857,633 | B1 | 2/2005 | Mackey |
| 6,937,152 | B2 | 8/2005 | Small |
| 7,008,289 | B2 | 3/2006 | Norman |
| 7,037,165 | B2 | 5/2006 | Garr |
| D554,202 | S | 10/2007 | Knight et al. |
| D554,203 | S | 10/2007 | Knight et al. |
| 7,285,034 | B2 | 10/2007 | Kay et al. |
| D555,210 | S | 11/2007 | Knight et al. |
| D555,211 | S | 11/2007 | Knight et al. |
| D555,212 | S | 11/2007 | Knight et al. |
| 7,371,148 | B2 | 5/2008 | Marine et al. |
| 7,467,985 | B2 | 12/2008 | Manrique |
| 7,527,542 | B2 | 5/2009 | Collins et al. |
| 7,537,509 | B2 | 5/2009 | Payne et al. |
| 7,591,705 | B2 | 9/2009 | Ciccarelli et al. |
| 7,594,844 | B2 | 9/2009 | Cartlidge et al. |
| 7,618,301 | B2 | 11/2009 | Knight et al. |
| 7,621,235 | B2 | 11/2009 | Genitrini |
| 7,628,674 | B2 | 12/2009 | Nuttall et al. |
| 7,637,377 | B1 | 12/2009 | Peckholdt, Jr. |
| 7,753,753 | B2 | 7/2010 | Payne et al. |
| 7,892,068 | B2 | 2/2011 | Nuttall et al. |
| 2002/0105143 | A1 | 8/2002 | Elliott et al. |
| 2003/0094757 | A1 | 5/2003 | Bedford |
| 2004/0266316 | A1 | 12/2004 | Li et al. |
| 2005/0153630 | A1 | 7/2005 | Delaney et al. |
| 2005/0164594 | A1 | 7/2005 | Garr |
| 2005/0176338 | A1 | 8/2005 | Delaney |
| 2006/0021905 | A1 | 2/2006 | Johnson |
| 2006/0040582 | A1 | 2/2006 | Hopper et al. |
| 2006/0087076 | A1 | 4/2006 | Collins et al. |
| 2006/0099874 | A1 | 5/2006 | Cartlidge et al. |
| 2006/0099875 | A1 | 5/2006 | Cartlidge et al. |
| 2006/0105665 | A1 | 5/2006 | Manrique |
| 2006/0119039 | A1 | 6/2006 | Reed et al. |
| 2006/0286891 | A1 | 12/2006 | Knight et al. |
| 2008/0081536 | A1 | 4/2008 | Payne et al. |
| 2008/0113585 | A1 | 5/2008 | Payne et al. |
| 2009/0004949 | A1 | 1/2009 | Payne |
| 2010/0075573 | A1 | 3/2010 | Dubois |
| 2010/0291833 | A1 | 11/2010 | O'Connor et al. |
| 2010/0304639 | A1 | 12/2010 | Payne et al. |

FOREIGN PATENT DOCUMENTS

| | | | |
|---|---|---|---|
| GB | 2178331 | A | 2/1987 |

OTHER PUBLICATIONS

Written Opinion dated Dec. 23, 2008 for PCT/US2008/065572, International Filing Date Jun. 2, 2008.

POP-UP PLAY SET

CROSS REFERENCE TO RELATED APPLICATIONS

This application is a continuation of U.S. patent application Ser. No. 12/131,838 filed Jun. 2, 2008 which claims the benefit of U.S. Provisional Patent Application Ser. No. 60/933,085 filed Jun. 2, 2007, the contents each of which are incorporated herein by reference thereto.

BACKGROUND OF THE INVENTION

Exemplary embodiments of the present invention relate generally to a pop-up play set for children's play, and more particularly to a pop-up play set that children use with toys, such as toy vehicles.

Pop-up play sets for children are typically of very simple design and construction, because the pop-up design necessitates such simplicity. Therefore, the level of play that a child can achieve with such play sets, while surely fun and educational, may be limited by the number of features that can be incorporated into such a play set. When not in use and closed, some play sets are often not very robust or portable.

SUMMARY OF THE INVENTION

Exemplary embodiments of the present invention provide an improved pop-up play set design that includes more details and features to enhance a child's play. Such features include more movable play features, such as rotating and bending pieces. The set also provides features that once assembled in the pop-up state may be extended or telescoped to maximize the play set's size and height. Moreover, the present invention maximizes the use of space and compactibility in the closed orientation, such that upon assembly into the folded-out, play orientation, the set also provides for more play surface area than existing play sets of similar size. This play set also provides a more robust, secure, and portable design when in the closed orientation. The features and advantages of the present invention are readily apparent from the following detailed description of the best mode for carrying out the invention when taken in connection with the accompanying drawings.

In one exemplary embodiment a play set is provided, the play set comprising: a main panel section having a first and second side lateral edge, and also having an upper main panel surface and a lower main panel surface. The play set also having a pair of side panel sections, each of which is pivotally connected to one of the first and second side lateral edges of the main panel section, and each also having a upper side surface and a lower side surface, one of the side panel sections further having a first latch portion and the other of the side panel sections having a second latch portion, the first and second latch panel sections releasably attachable with each other to define a latch; and wherein when the play set is in a first orientation, the main panel section and the pair of side panel sections are oriented generally co-planar to each other such that the upper main panel surface and upper side surfaces define a play surface having a perimeter, and wherein when the play set is in a second orientation, the pair of side panel sections are adjacent to each other and in a plane parallel to the main panel section to define a play set case, and the upper main panel surface and upper side surfaces define an inner compartment of the play set case, and the first and second latch portions are reliably attached to each other, further wherein in the first orientation, at least one of the main panel sections and pair of side panel sections includes an elongated member extendable therefrom in a telescoping manner to define an additional play surface outside the perimeter of the main panel sections and side panel sections.

In another exemplary embodiment, a play set is provided, the play set comprising: a base section having a central portion and a pair of side portions that define an upper play surface. The play set also has an elevated platform section secured to one of the pair of side portions, the elevated platform being movable from an extended position and a collapsed position with respect to the upper play surface; and an extendable member for movement between an extended position that broadens the upper play surface area of the play set be extending beyond a perimeter of the base section and a retracted position, wherein the extended member is received within a perimeter defined by at least one portion of the base section.

In another exemplary embodiment, a method for providing a pop up play set having an extended play surface when the pop up play set is in a deployed position and wherein the pop up play set has a reduced profile when the pop up play set is in a stowed position is provided, the method comprising: pivotally securing an extendable member to a base portion of the play set, the extendable member being configured for movement between an extended position that broadens an upper play surface area of the play set by extending beyond a perimeter of the base section and a retracted position, wherein the extended member is received within a perimeter defined by at least one portion of the base section, the extendable member having a first portion pivotally secured to the base section and a pair of telescoping members configured to extend from the first portion. The method further comprising movably securing an elevated platform to one of a pair of side portions of the base section, the elevated platform being movable from an extended position and a collapsed position with respect to the upper play surface area; and connecting the elevated platform with the base section by a ramp member pivotally secured to the elevated platform at one end and slidably received on the base section at another end, wherein movement of the elevated platform between the extended position and the collapsed position will cause the ramp member to pivot with respect to the elevated platform and slide with respect to the base section.

BRIEF DESCRIPTION OF THE DRAWINGS

Other advantages of exemplary embodiments of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
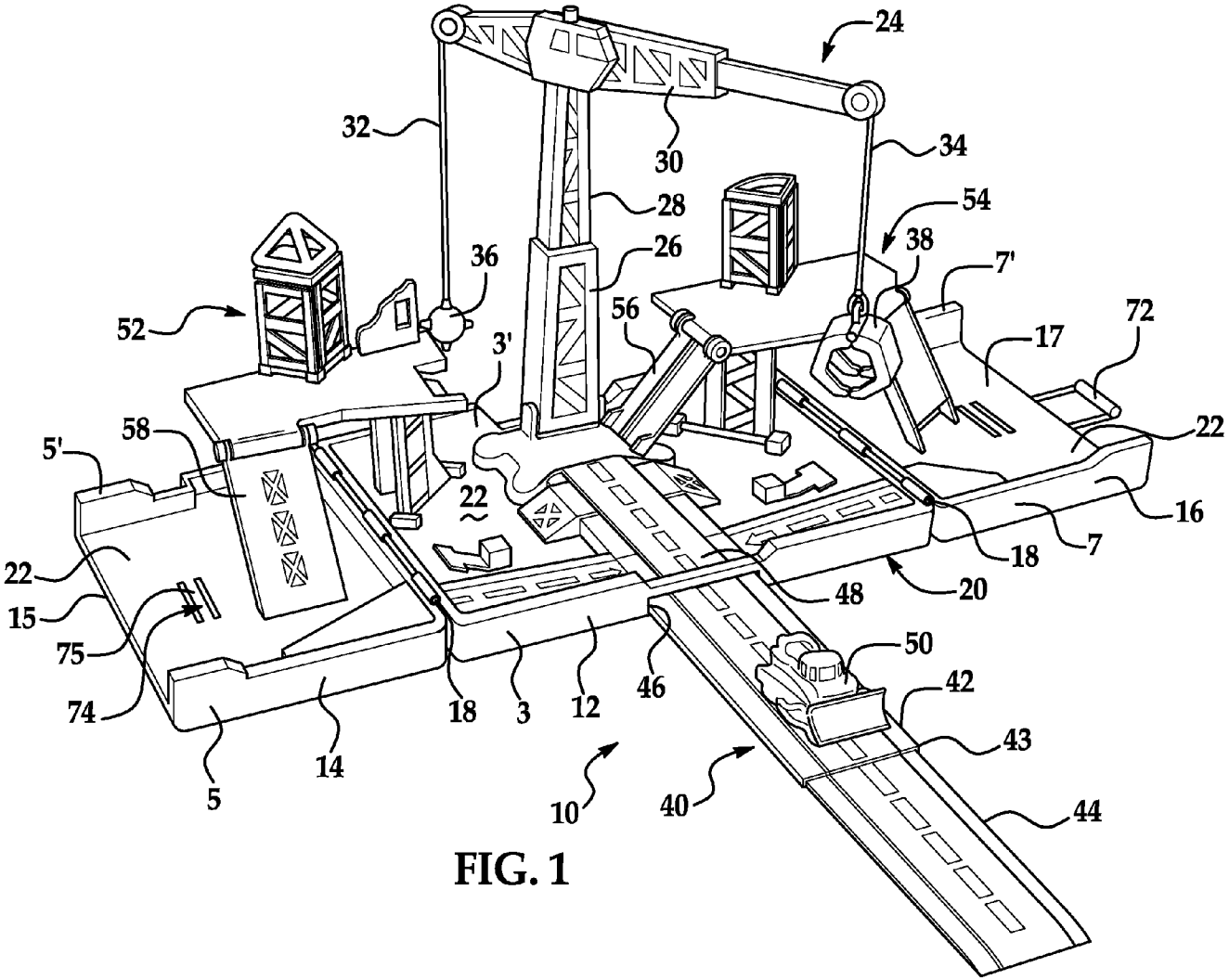
FIG. 1 is a side perspective view of an assembled, unfolded, pop-up play set according to a first embodiment of the present invention.

A pop-up play set 10 according to a first non-limiting embodiment of the invention is shown in FIG. 1, in the fully open and assembled, pop-up orientation. As shown, play set 10 illustrates a construction theme. When unfolded, the surface of play set 10 is partially defined by a plurality of sections 12, 14, 16 which are pivotally and rotatably attached together via hinges 18 to define generally flat, co-planar lower surface 20. The three sections 12, 14 and 16 may be referred to as forming a tri-fold play set. Of course, exemplary embodiments of the present invention are not limited to a tri-fold play set (e.g., greater than or less than three sections may also be employed).

Figure 2:
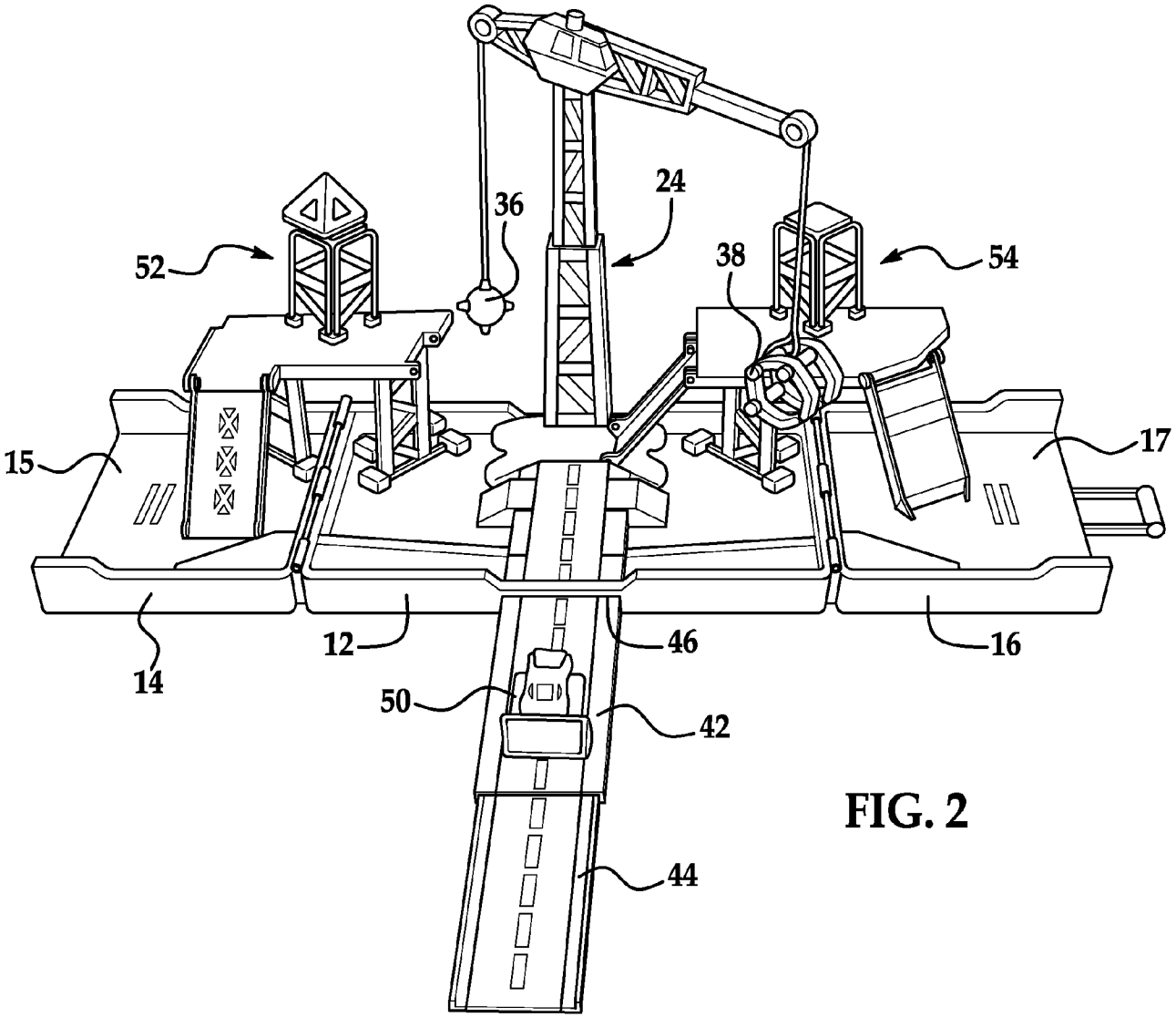
FIG. 2 is a front perspective view of an assembled, unfolded, pop-up play set according to the first embodiment of FIG. 1.
Figure 3:
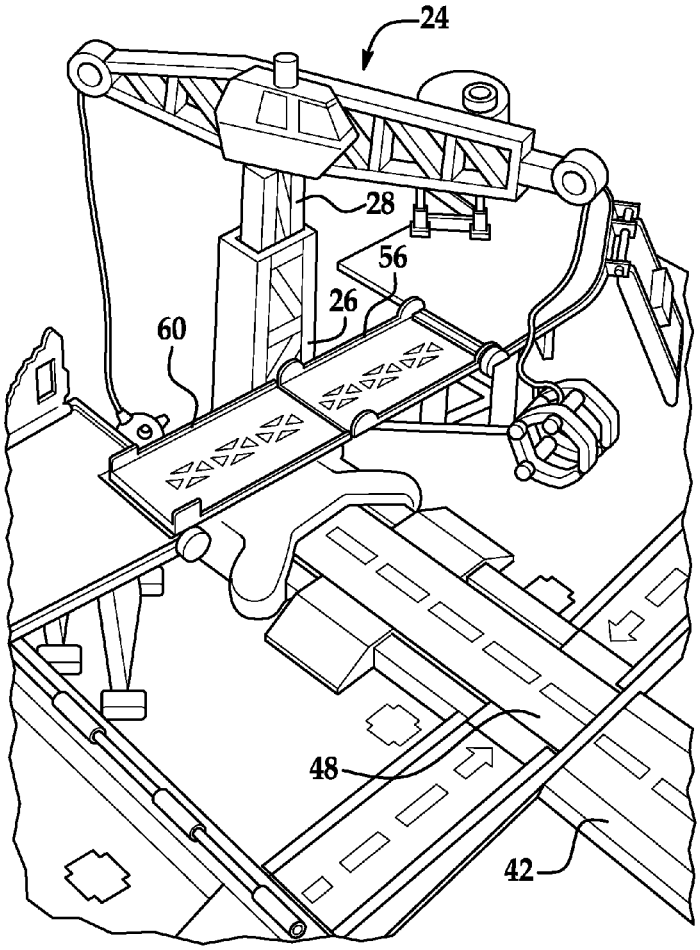
FIG. 3 is close up view of a portion of the pop-up play set of FIG. 1.

In FIG. 1, sections 12, 14 and 16 have front and rear wall sections (3, 3', 5, 5', 7, 7') which (along with edges 15 and 17) define a perimeter as well as an upper play surface 22 of play set 10. Set 10 also includes different features generally consistent with the theme (but does not necessarily have to be consistent). For example, upper surface 22 includes a main vertical member, shown in this embodiment as movable crane 24, and which includes a lower crane portion 26, an upper crane portion 28, and a top crane portion 30. Crane 24 is axially movable up and down by telescoping, such that when upper crane portion 28 is axially received within lower crane portion 26 (see FIG. 3), the crane 24 becomes the appropriate height to be pivoted downwardly for purposes of closing the play set (see FIG. 4.) However, to achieve enhanced play, the upper crane portion 28 is axially extended upwardly and elongated, such that the crane 24 has a height taller than the width of the play set (i.e. if the crane was folded downwardly when in this elongated orientation, it would extend beyond the perimeter and the play set would not be able to be closed). As shown in FIGS. 2 and 3, top crane portion 30 is rotatable, and includes one or more flexible wires or bands 32, 34 extending downwardly therefrom. One wire 32 includes a toy wrecking ball 36 at its lower end, while the other wire 34 includes a jaws-style clamp 38 at its lower end.

Play set 10 also includes an extendable member feature 40 that maximizes and broadens the entire play surface area of the set. As shown in FIGS. 1 and 2, the extendable member 40 is shown as a road which is telescopingly movable in a first orientation where it is disposed in the housing of one or more of the play set sections, the member 40 being receivable within the base of main panel section 12; and which in the second orientation in the fully assembled play mode, the road 40 is extendable outwardly from main panel section 12 to maximize the overall play area of play set 10. Member 40 also includes a plurality of member sections, shown as road sections 42, 44.

Figure 4:
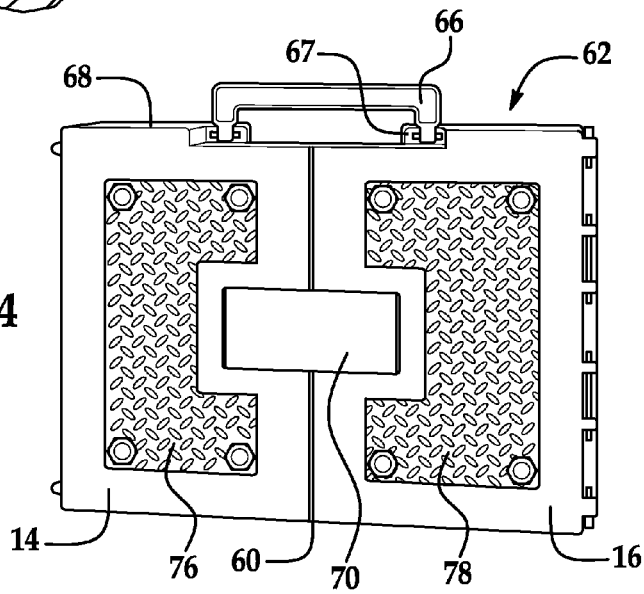
FIG. 4 is a front elevational view of the pop-up play set of FIG. 1 in a closed and secured orientation.

When folding up and closing the play set, the user pushes section 44 such that it is telescopingly received within section 42 (the front edge of which is shown by edge 43), and then both sections may be received into an appropriately sized opening 46 in the housing of section 12, so that it is secure and out of the way (as in FIG. 4 where it is not visible.) As an added feature, the upper surface 22 of the play area includes a road design portion 48 which is aligned with sections 42 and 44 in order to continue the theme into upper play area 22. As shown in FIG. 1, a user may operate his/her toy vehicle 50 up the road sections 42 and 44 and then onto road section 48 of play surface 22 to continue the journey.

Other features of play set 10 include raised platforms 52 and 54 on sections 14 and 16, respectively. FIG. 1 shows that one of platforms 54 includes a ramp 56 which become bridge portion 58 in FIG. 3. Bridge portion 58 is pivotably connected to platform 54 such that it is movable from the collapsed state of FIG. 1 to the elevated state of FIG. 3. As shown in FIG. 3, the bridge portions 58 and 60 may be assembled such that bridge portion 60 is secured to platform 52. Thus a user may drive toy vehicle 50 across bridge 56 thereby traversing across play set 10 from one side (portion 16) to the opposite side (portion 14).

FIG. 4 shows play set 10 in its closed and unassembled orientation. As shown therein, the expansive play area illustrated in FIG. 1 may be folded up and closed into the compact case 62 of FIG. 4, so that outer edges of sections 14 and 16 are adjacent and generally parallel with each other along plane 66. Case 62 includes a carrying handle 66 that is pivotably mounted at hinges 67 to an edge of main panel section 12 that partially defines an upper surface 68 of case 62 when in the closed position. Case 62 also include a latch portion 70 which extends across adjacent edges 15, 17 of sections 14, 16 to latch together panels 14, 16 and secure the case for portability and handling when not in use. As best shown in FIG. 2, when unfolded, the latch includes a first latch portion 72 extending from section 16 and a second latch portion 74 (defined by rod 75) on section 14. Upon latching as in FIG. 5, first latch portion is pivoted across plane 66 and has a catch surface which grabs onto rod 75 for securing the surfaces together. Surface areas 76, 78 of panels 14, 16 slow additional industrial themed detail in order to tie the outer case to the theme of the play set 10.

Figure 5:
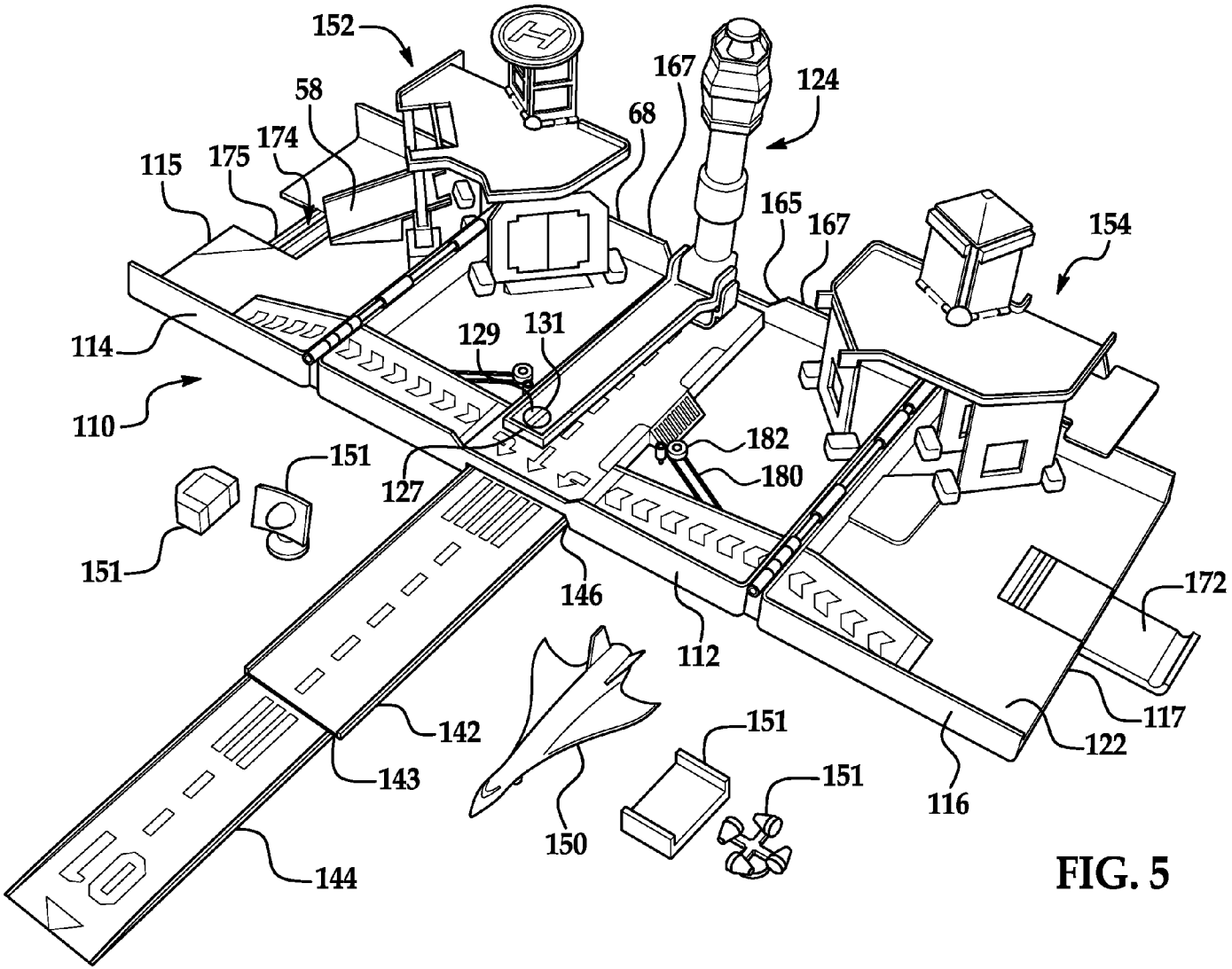
FIG. 5 is a perspective view of an assembled, unfolded, pop-up play set according to a second embodiment of the present invention, wherein some of the play pieces are sitting outside of the play surface.

FIGS. 5 through 8 illustrate a play set 110 according to a second embodiment of the present invention. For ease of reference, those features of the second embodiment that are similar to the first embodiments will bear a similar reference number, with the addition of a "1" prefix. Play set 110 is shown in FIG. 5 in the fully open and assembled, pop-up orientation. Play set 110 illustrates an aviation/airport theme. When unfolded, the surface of play set 110 is partially defined by a plurality of sections 112, 114, 116 which are pivotably and rotatably attached together via hinges 118 together to define generally flat, co-planar lower surface 120.

Figure 9:
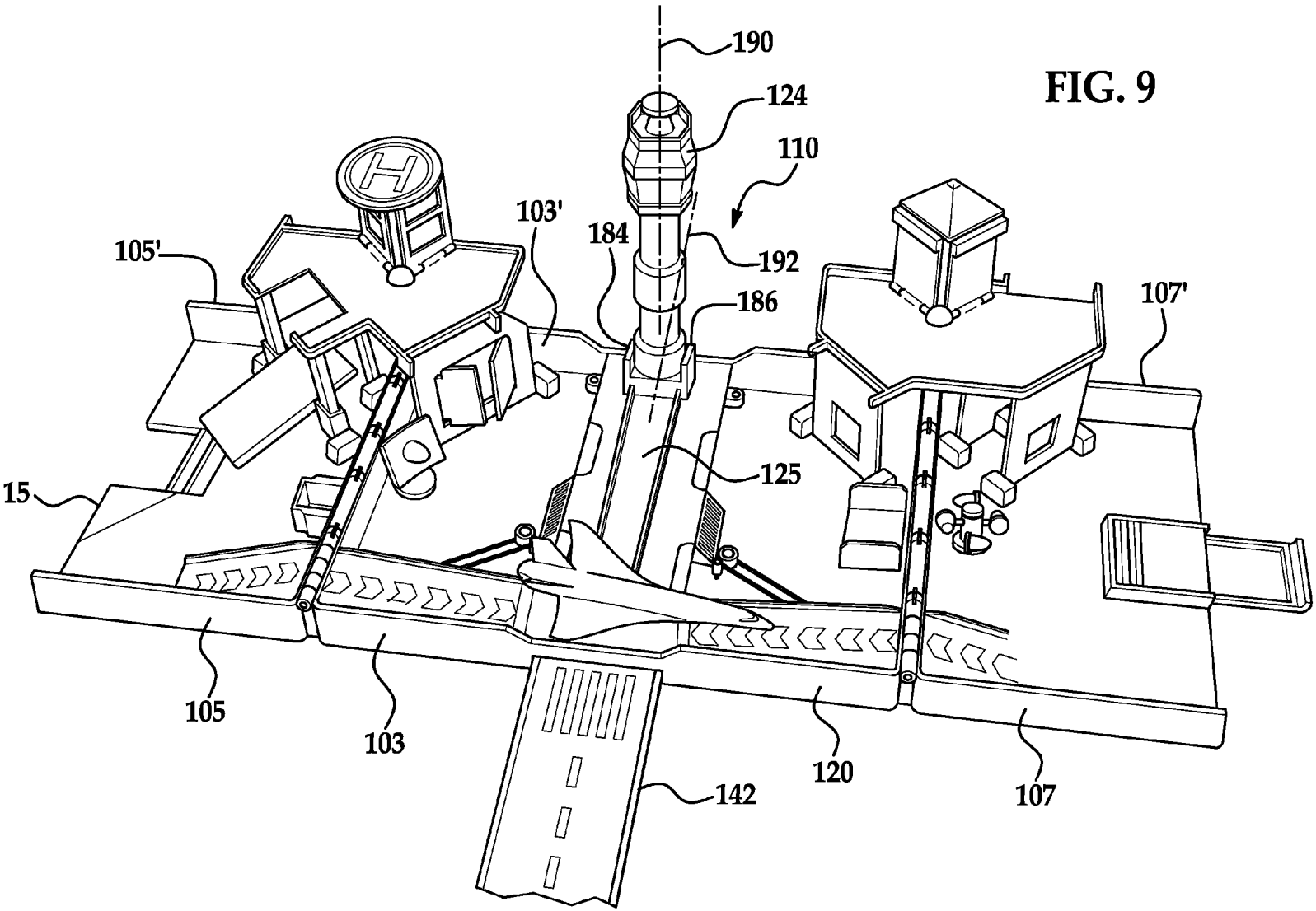
FIG. 9 shows another view of the play set of FIG. 5.

In FIG. 5, sections 112, 114 and 116 have front and rear wall sections (103, 103', 105, 105', 107, 107') which (along with edges 115 and 117) define a perimeter as well as an upper play surface 122 of play set 110. In FIG. 5, the upper play surface 122 of play set 110 includes different features generally consistent with the theme. For example, upper surface 122 includes in this embodiment a main vertical member, which is shown as movable control tower 124. However, control tower 124 is movable in a manner different than crane 24 of play set 10. Tower 124 has attached to its lower end an inwardly extending, horizontal member 125, oriented generally perpendicular thereto. A vehicle, such as airplane 150 is removably attached to a free end portion 127 of member 125. End portion 127 includes a mounting portion 129 which mates with a corresponding portion disposed on the underside of airplane 150 (not shown) and mounting the airplane thereto. In this embodiment, mounting portion 129 is a raised projection having a narrow slot 131 thereacross for receiving a mating portion of airplane 150. Consistent with the given theme, control tower 124 is rotatable and pivotable and may be operable by the user as a handle in order to lift and manipulate member 125 (and hence airplane 150) into various orientations thereby simulating a flying movement for airplane 150. Thus when tower 124 is manipulated and pivoted by a user, the mounting interfaces 184, 186 between the member 125 and tower 124 means that manipulating the tower 124 imparts movement to member 125 and thus to airplane 150. It is understood that as control tower 150 is rotated and pivoted, it may be oriented from vertical as shown in FIG. 5 (and FIG. 9 as defined by centerline 190), through to a horizontal or near horizontal position as shown by centerline 192 in FIG. 9 (i.e. generally planar with surface 122) in order to maximize the flight play. As shown in FIG. 5, random themed play pieces 151 are also included, such as a wind sock, radar, luggage cart, lights, etc.

Figure 6:
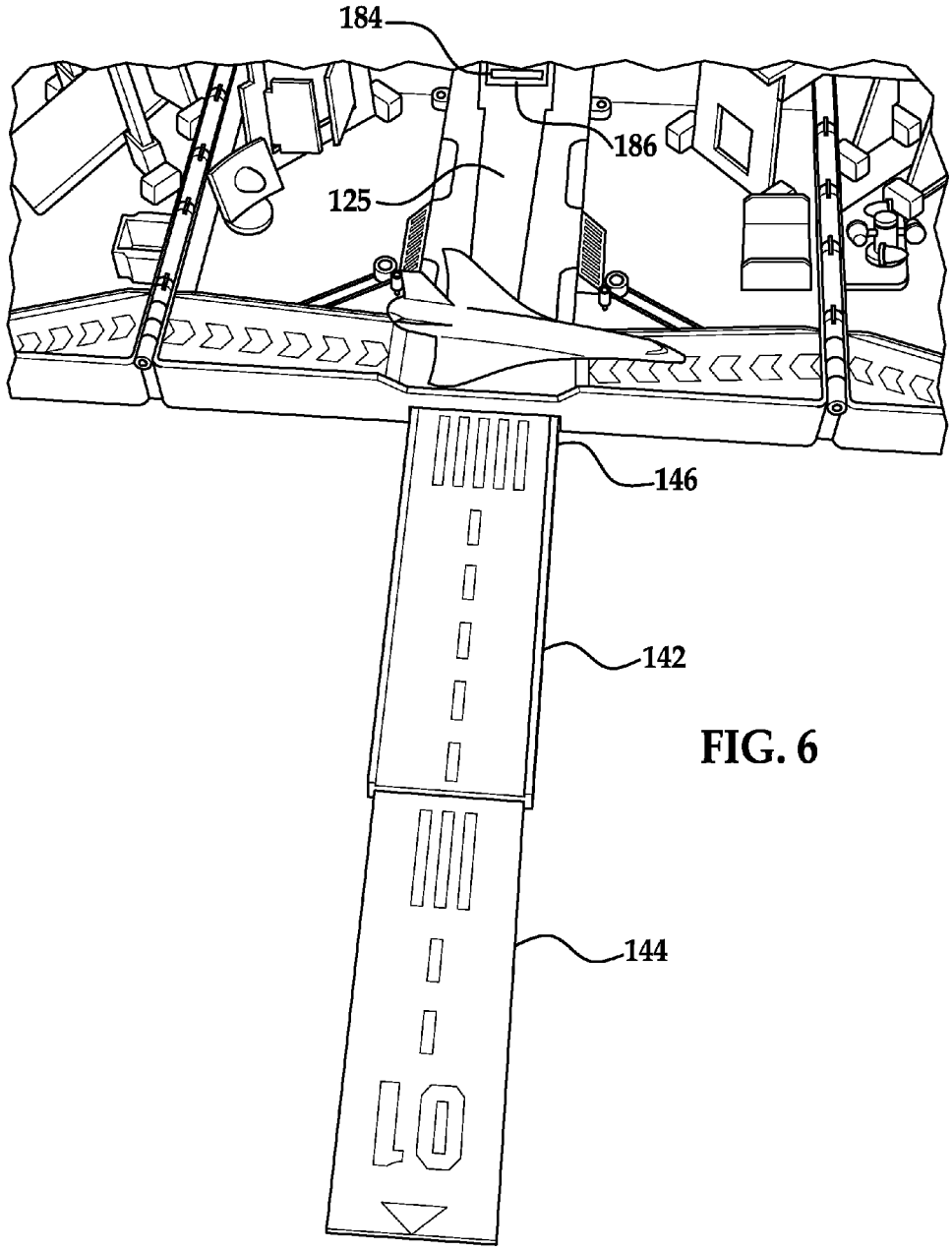
FIG. 6 shows a portion of the play set of FIG. 5, with the toy airplane mounted in flight take-off position.
Figure 7:
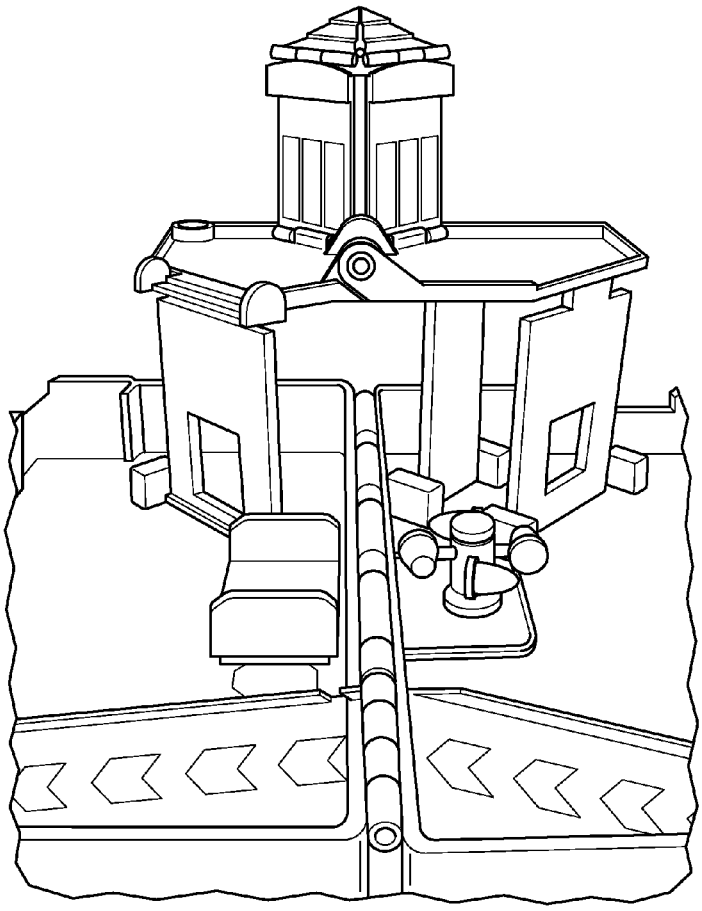
FIG. 7 shows a portion of the play set of FIG. 5 illustrating the towers.

Play set 110 also includes an extendable member feature 140 that broadens the entire play surface area of the set. As shown in FIGS. 5 and 6, the extendable member 140 is shown as a landing strip which is telescopingly movable in a first orientation where it is disposed in the housing of at least one of the play set sections, shown here as being received within the housing of main section 112; and which in the second orientation in the fully assembled play mode, the landing strip 140 is extendable outwardly from main section 112 to maximize the overall play area of play set 110. Landing strip 140 includes a plurality of strip sections 142, 144. When folding up and closing the play set, the user moves section 144 such that it is telescopingly received within section 142 (the front edge of which is shown by edge 143), and then both sections may be received into an appropriately sized opening 146 in the housing of section 112, so that it is secure and out of the way. As an added feature, the upper surface 122 of the play area includes an additional landing strip design portion 148 which is aligned with sections 142 and 144 in order to continue the theme into upper play area 122. As shown in FIG. 1, a user may operate his/her toy vehicle (airplane) 150 up the landing strip sections 142 and 144 and then onto landing strip section 148 of play surface 122 to continue the journey.

Other features of play set 110 include raised platforms 152 and 154 on sections 114 and 116, respectively. While not shown, it is understood that the play set folds and closes up into a carrying case similar to the first embodiment shown in FIG. 4. The case includes a carrying handle that is pivotably mounted at hinges 167 to an edge 165 of main panel section 112 that partially defines an upper surface 168 of the case when in the closed position. Case also includes a latch portion 170 which extends across adjacent edges 115, 117 of sections 114, 116 to latch together panels 114, 116 and secure the case for portability and handling when not in use. As best shown in FIG. 5, when unfolded, the latch includes a first latch portion 172 extending from section 116 and a second latch portion 174 (defined by rod 175) on section 114. Upon latching as in FIG. 5, first latch portion has a catch surface which grabs onto rod member 175 for securing the side surfaces together.

Figure 8:
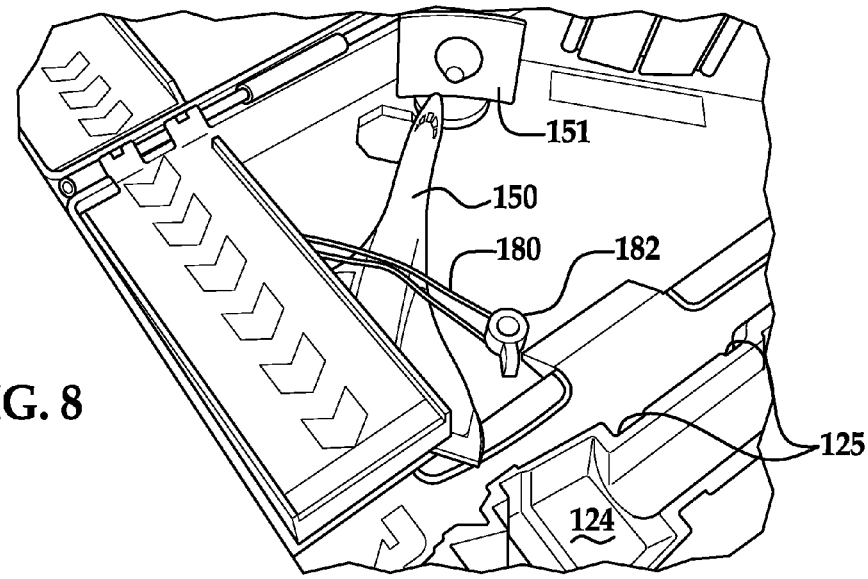
FIG. 8 shows a portion of the play set of FIG. 5 showing how some of the loose accessories are retained within the play set case, as well as the vertical member (control tower) collapsed.

FIG. 8 shows how the airplane and other play pieces may be secured within the play case when closed into a case as in FIG. 4, or when otherwise being moved or transported. As shown there, airplane 150 is retained under a band 180 which is secured to upper surface 122 by posts 182 and which provide enough stretch and tension to accommodate pieces of different size and shape, yet having the tension to retain them securely. FIG. 8 also shows control tower 124 pivoted downwardly in a collapsed position and laying on top of member 125 in preparation for the play set 110 to be folded and closed (crane 24 of the first embodiment is pivoted downwardly and adjacent play surface 22 for closing in a similar manner.) Play sets 10, 110 are preferably formed of plastic but may also be formed of various types of metal, paperstock/cardboard, or a combination thereof.

Figure 10:
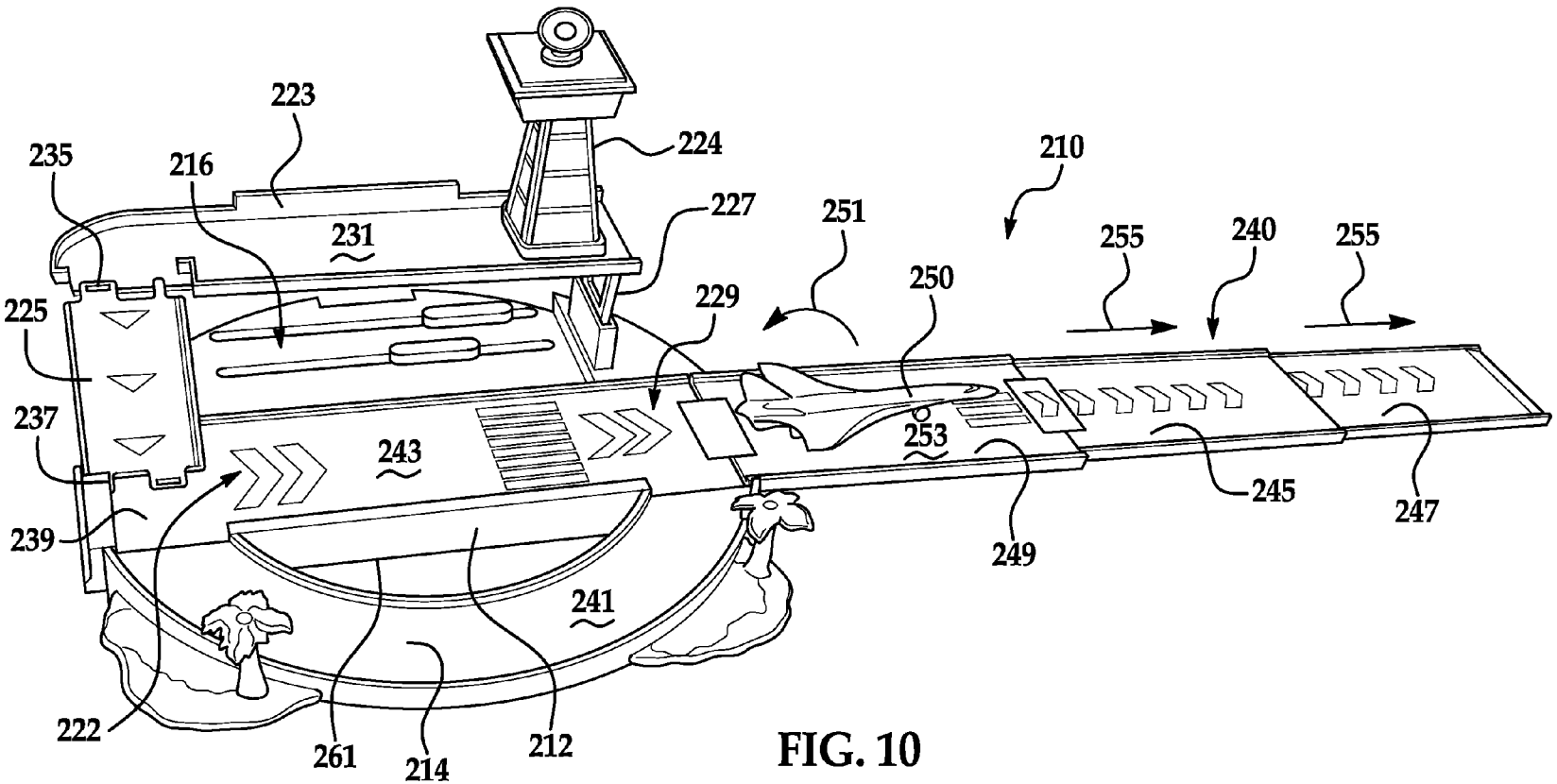
FIGS. 10 and 11 are perspective views of an alternative exemplary embodiment of the present invention.
Figure 11:
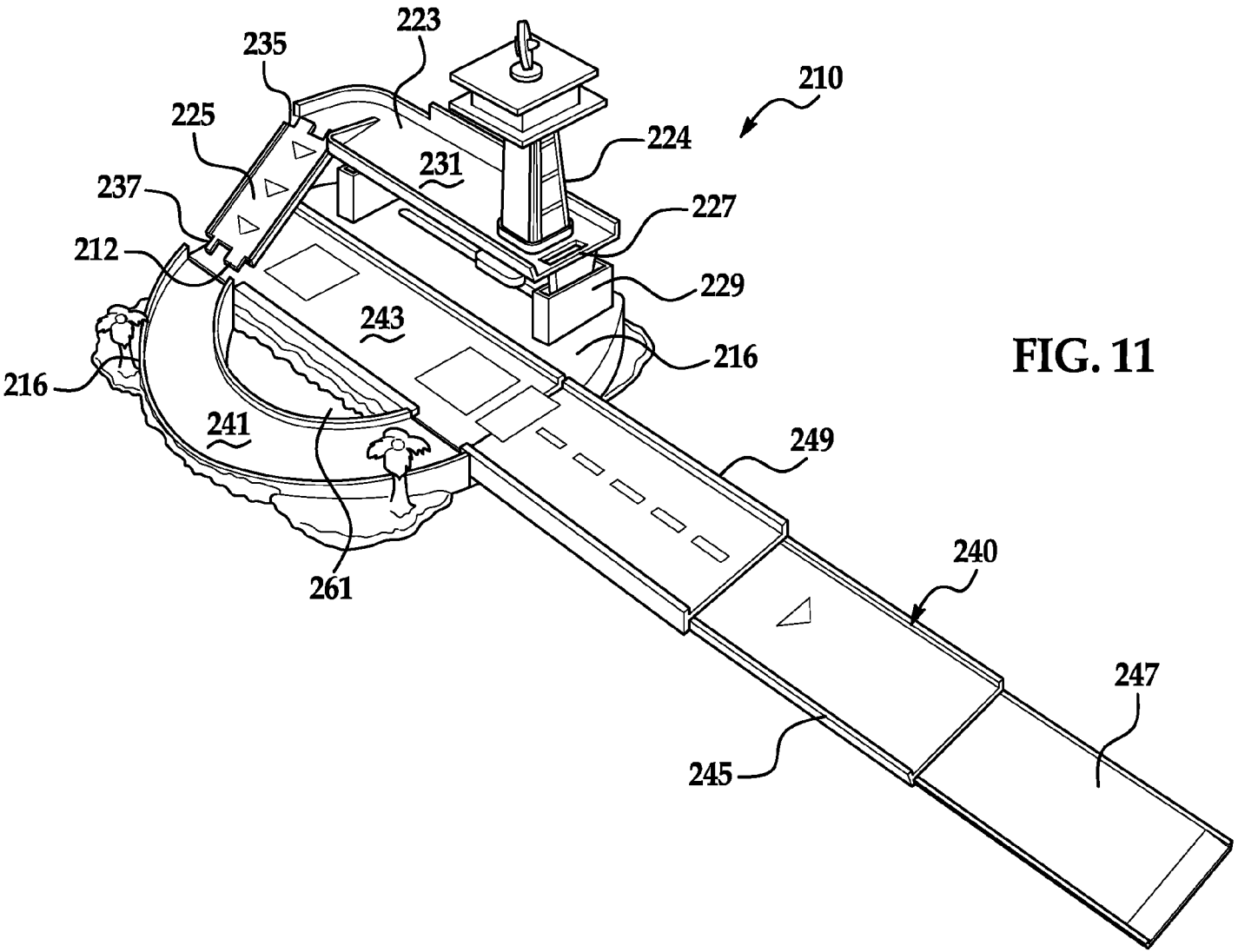

Referring now to FIGS. 10-15 a play set 210 according to still another exemplary embodiment of the present invention is illustrated. For ease of reference, those features of the second embodiment that are similar to the first embodiments will bear a similar reference number, with the addition of a "2" prefix. Play set 210 is shown in FIGS. 10 and 11 in the fully open and assembled, pop-up orientation. Similar to the second embodiment, play set 210 illustrates an aviation/airport theme. When unfolded, the surface of play set 210 is partially defined by a plurality of sections 212, 214, 216 which can be removably, pivotally/rotatably or permanently attached together to define a generally flat, co-planar lower surface 220 to support play set 210. As illustrated, a base platform 211 is provided by sections 212, 214 and 216 that can be integrally molded together as one set or one or all of the sections may be removably secured to each other or one or all of the sections may be pivotally or rotatably secured to each other to further provide a stowable pop up play set. In still another alternative exemplary embodiment, sections 212, 214 and 216 are integrally or fixedly secured to each other such that base platform 211 is provided (e.g., platform 211 is provided by sections 212, 214 and 216 and sections 214 and 216 are not pivotally or rotatably secured to section 212 or in other words platform 211 is one unitary structure).

As illustrated, section 212 is a central section or portion while sections 214 and 216 are side sections or portions. Sections 212, 214 and 216 define an upper play surface 222 of play set 210. In an exemplary embodiment, the upper play surface 222 of play set 210 includes different features generally consistent with the theme. For example and in this embodiment, upper surface 222 includes an elevated platform 223 secured to section 216, which includes a structural feature such as a control tower 224 and a ramp member 225 extending from the elevated platform to a portion of the upper surface defined by section 212. Ramp member 225 provides a portion of a road surface extending from the elevated platform. In this embodiment, the elevated platform is movable with respect to surface 222 and in particular, section 216. Of course, elevated platform 223 and ramp member 225 can be secured to any portion of base member 211 defined by sections 212, 214 and 216. It is also understood that the number of sections defining base member 211 may also vary to be greater or less than three.

In order to provide for the movement of elevated platform, a pair of telescoping leg members 227 are secured to the elevated platform and are slidably received within complimentary support structures 229 of section 216 for movement between a first collapsed position (FIG. 14) and a second elevated position (FIGS. 10, 11, 12, 12A) wherein a portion of the leg members 227 is received within support structures 229 when the platform 223 is in the collapsed position. In one exemplary embodiment and referring now to FIG. 14, the pair of telescoping leg members are completely received within complimentary support structures 229 when the elevated platform is in the collapsed position. Thereafter and as the platform is moved from the collapsed position to the elevated position, a portion of the leg members is slid out of the support structures while a remainder of the leg portion still remains within the support structure in order to secure the elevated platform to the base structure. Alternatively, only portions of the telescoping leg members are received within the complimentary support structures when the elevated platform is in the collapsed position (e.g., portions up the leg members extend out of the support structures when the elevated platform is in the collapsed position). In still one other non-limiting alternative embodiment elevated platform 223 can be fixedly secured to base member 211 wherein no movement of the platform is provided.

In accordance with an exemplary embodiment of the present invention, the control tower is secured to a portion of the elevated platform to define an airport scene. The elevated platform further defines an elevated road surface 231 that is connected to ramp member 225, which is pivotally mounted to the elevated platform 223 at one end 235 and slidably received on section 212 at another end 237, wherein a portion of the ramp member is slidably received within a slot, channel or feature formed in section 212 such that upon collapsing of the elevated platform from the position illustrated in FIGS. 10, 11, 12, 12A to that of FIG. 14, a portion of end 237 will slide in feature 239 and end 235 will pivot with respect to elevated platform 223 to allow the same to travel upward and downward with respect to surface 222. It being understood that the pivotal securement of ramp member 225 to platform 223 may performed by any suitable structure (e.g., pins, hinges and equivalents thereof) while the slidable movement of ramp member 225 with respect to section 212 may also be performed by any suitable structure (e.g., channel, slot, retention feature and equivalents thereof).

Consistent with the airport theme, section 214, in one embodiment, defines a road portion 241 that defines a path that connects with a path defined by ramp member 225. In one exemplary embodiment section 214 and 212 are configured such that an opening 261 is provided therebetween such that when the extendable feature 240 is in the stowed position illustrated in FIG. 16 and/or the elevated platform is in the collapsed position illustrated in FIG. 14 an individual may use opening 261 and section 214 to provide a handle for carrying the pop up play set (e.g., for placing away, storage, bringing to a friend's house and for taking on a trip, etc.). Of course, other configurations (e.g., buildings, structures, scenery, no roads, etc.) are considered to be within the scope of exemplary embodiments of the present invention. In addition and in one embodiment, section 212 defines a portion of a runway or landing strip 243, which in one embodiment connects with road 241 of section 214. A vehicle, such as airplane 250 is provided to simulate landings and take offs at the airport.

Play set 210 also includes an extendable member or extendable feature 240 that broadens the entire play surface area of the set. As shown in FIGS. 10, 11, 14 and 15, the extendable member 240 is shown as a landing strip which has telescopingly extending portions 245 and 247 and a first portion 249. In accordance with an exemplary embodiment of the present invention, the extendable member extends from a perimeter of the base portion in order to enlarge the play area of the pop-up play set. In accordance with an exemplary embodiment of the present invention, first portion 249 is pivotally or rotatably mounted to section 212 at one end such that all of extendable member feature 240 can be received within the footprint or perimeter of at least section 212. In an exemplary embodiment, first portion 249 is pivotally or rotatably mounted to section 212 such that the same may be folded back onto section 212 in the direction of arrow 251.

In order to extend feature 240, telescopingly extending portions 245 and 247 extend from first portion 249 and then section 247 extends from section 245, wherein section 247 extends from a cavity (not shown) in section 245 and section 245 extends from a cavity (not shown) in first portion 249. In being understood that as used herein, cavity refers to any means open or closed or partially closed that allows a respective section to be slidably or telescopingly received within another section while still being secured thereto. In order to stow feature or landing strip 240 within the perimeter defined by section 212 each telescoping section is retracted in a direction opposite to arrows 255 and first portion 249 is folded back upon section 212 or the surface defining landing strip 243 by rotating the same in the direction of arrow 251 such than an upper surface 253 of first portion 249 is positioned on top of the surface of section 212 defining landing strip 243 (see for example FIG. 16). In order to deploy extendable portion 240 and maximize the play area of play set 210, the first portion of extendable feature 240 is moved or rotated in a direction opposite to arrow 251 while sections 245 and 247 are extended outwardly in the direction of arrows 255 thus, the feature 240 is extendable to the position illustrated in FIGS. 10, 11, 14 and 15 wherein sections 245 and 247 are extended outwardly in the direction of arrows 255.

Although only one extendable feature 240 is shown, it is understood that exemplary embodiments of the present contemplate numerous features 240 or a single feature 240 wherein the feature may have any combination or number of members (249, 245, 247 (e.g., although only three sections are shown, greater or less than three sections are contemplated to be within the scope of exemplary embodiments of the present invention) that are extendably secured to each other to provide a member that increases the play area (e.g., extend from the perimeter of base section 211) while also allowing the same to be packed up and stowed for storage and/or transportation wherein the stowed play set occupies much less area (e.g., height and perimeter) then when it is in its extended or deployed position. In accordance with an exemplary embodiment of the present invention, the extendable feature 240 is deployable from a stowed position with respect to a section of the play set to a deployed position (e.g., extended play area) and vice versa wherein a plurality of segments are deployably and retractably (e.g., rotatably, pivotally, and extendably) secured to each other.

Accordingly, play set 210 provides a collapsible play set for storage and travel wherein elevated platform 223 is movable from a first collapsed position (FIG. 14) and a second elevated position (FIGS. 10, 11, 12, 12A) wherein a portion of the leg members 227 is received within support structures 229 when the platform 223 is in the collapsed position. In one embodiment, either members 227 or support structure 229 or both have a feature (e.g., deflectable members having a resilient quality and a protrusion configured to engage a complimentary feature) configured to retain the elevated platform in the first collapsed position and/or the second elevated position wherein a light pulling or pushing force is required to disengage the features retaining the same in the elevated or collapsed position.

As an added feature, the upper surface of section 212 that defines landing strip 243 is aligned with sections 249, 245 and 247 in order to continue the theme into the play area defined by the play set. As shown in FIG. 10, a user may operate his/her toy vehicle (airplane) 250 along landing strip 243 through sections 249, 245 and 247 to continue the journey of plane 250. Furthermore, elevated platform 223, ramp member 225 and section 214 defined portions of a road that may be traversed along two levels in which a user may manipulate a plane, car or other vehicle associated with the play set.

As mentioned above, other features of play set 210 include the extendable and collapsible platform 223. While not shown, it is understood that play set 210 folds and collapses into a smaller profile wherein platform 223 is moved closer to section 216 (FIG. 14) and extendable member 240 collapses and folds back onto section 212.

Figure 12:
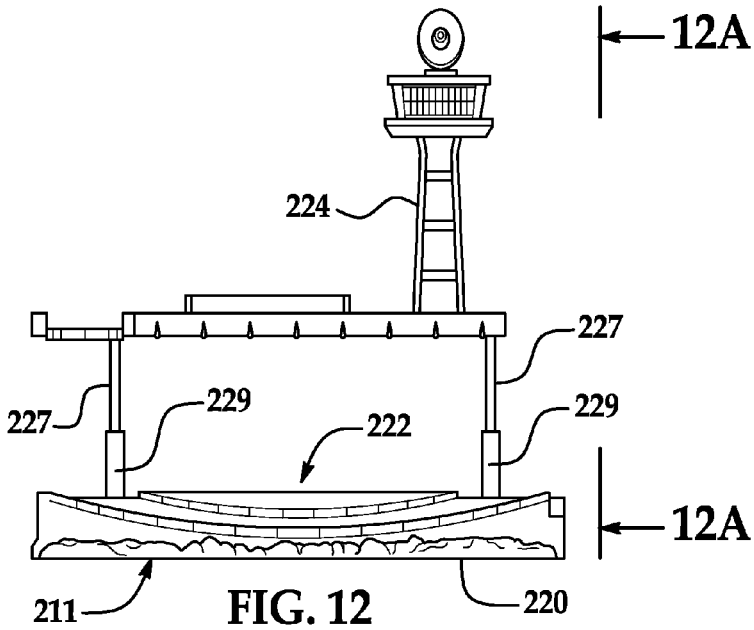
FIG. 12 is a side view of an alternative exemplary embodiment of the present invention.
Figure 12A:
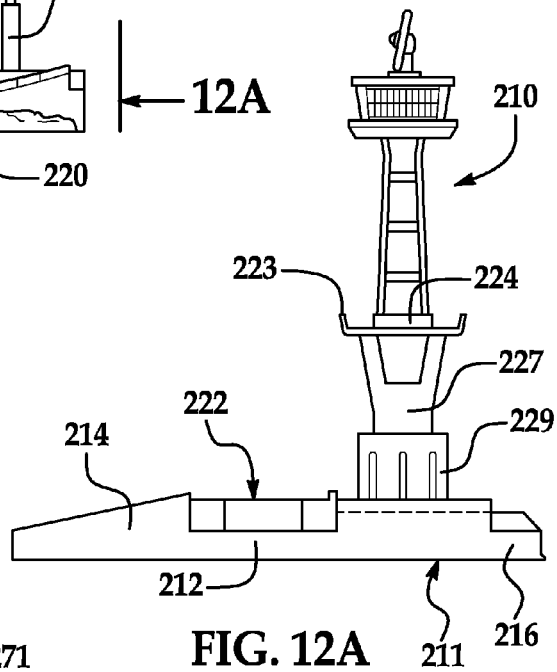
FIG. 12A is a view along lines 12A-12A of FIG. 12.
Figure 13:
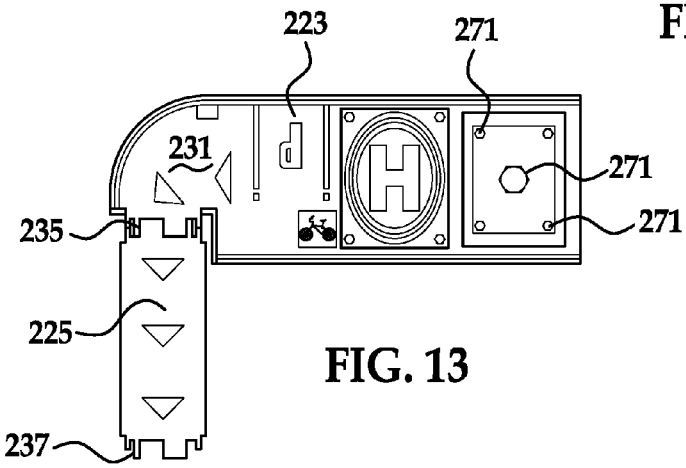
FIG. 13 is a top view of portion of the embodiment illustrated in FIG. 12.
Figure 14:
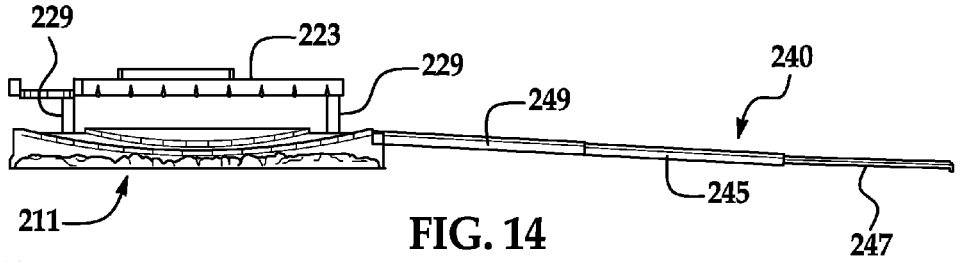
FIG. 14 is a side view of a portion of an alternative exemplary embodiment of the present invention.
Figure 15:
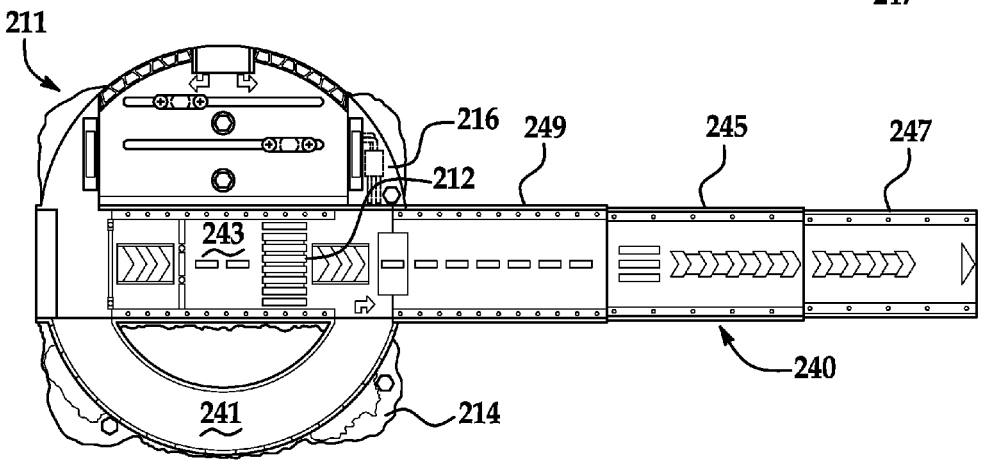
FIG. 15 is a top view of a portion of an alternative exemplary embodiment of the present invention.

FIG. 13 illustrates a top view of platform 223 with ramp member 224 and control tower 224 removed from platform 223. In one exemplary embodiment, control tower 224 is secured to platform 223 by engaging securement openings 271. The control tower may be removably or fixedly secured to platform 223. FIG. 12 illustrates a side view of play set 210 with platform 223 in an extended position (note: FIG. 12 illustrates play set 210 without extendable member 240). FIG. 12A is a view along lines 12A of FIG. 12 and FIG. 14 a side view of play set 210 with platform 223 in a collapsed position (note: FIG. 14 illustrates play set 210 without tower 224 however extendable member 240 is shown in the extended position). FIG. 15 is a top view of the play set without elevated platform 223 and extendable member 240 is shown in the extended position.

Figure 16:
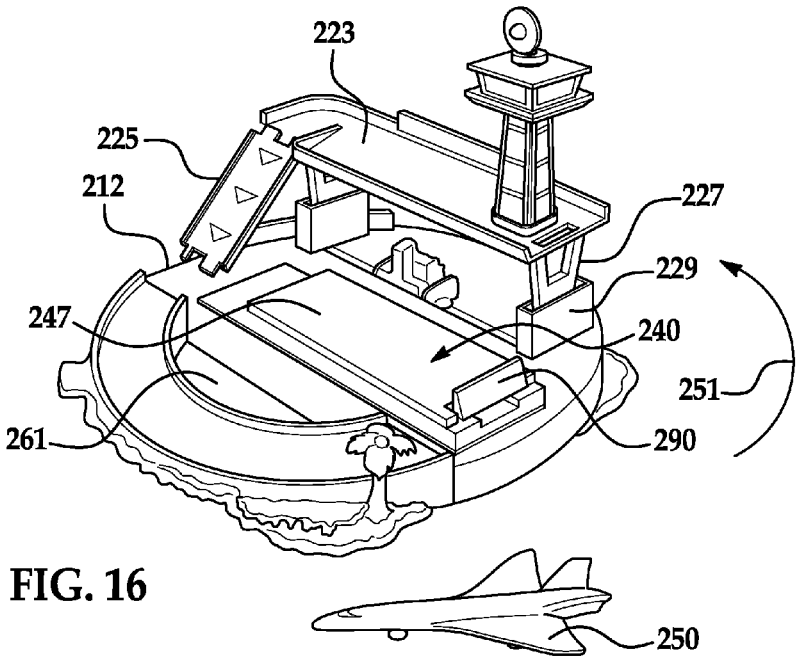
FIGS. 16-18 illustrate an alternative exemplary embodiment wherein the extendable feature is illustrated in various stages of an extended and a stowed position.
Figure 17:
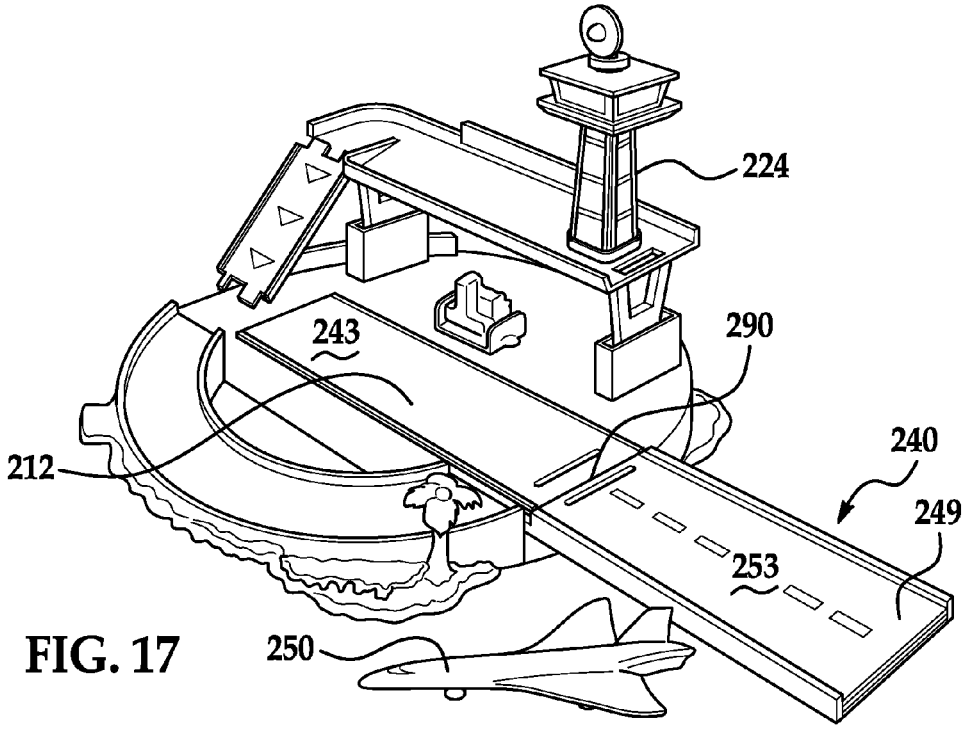
Figure 18:
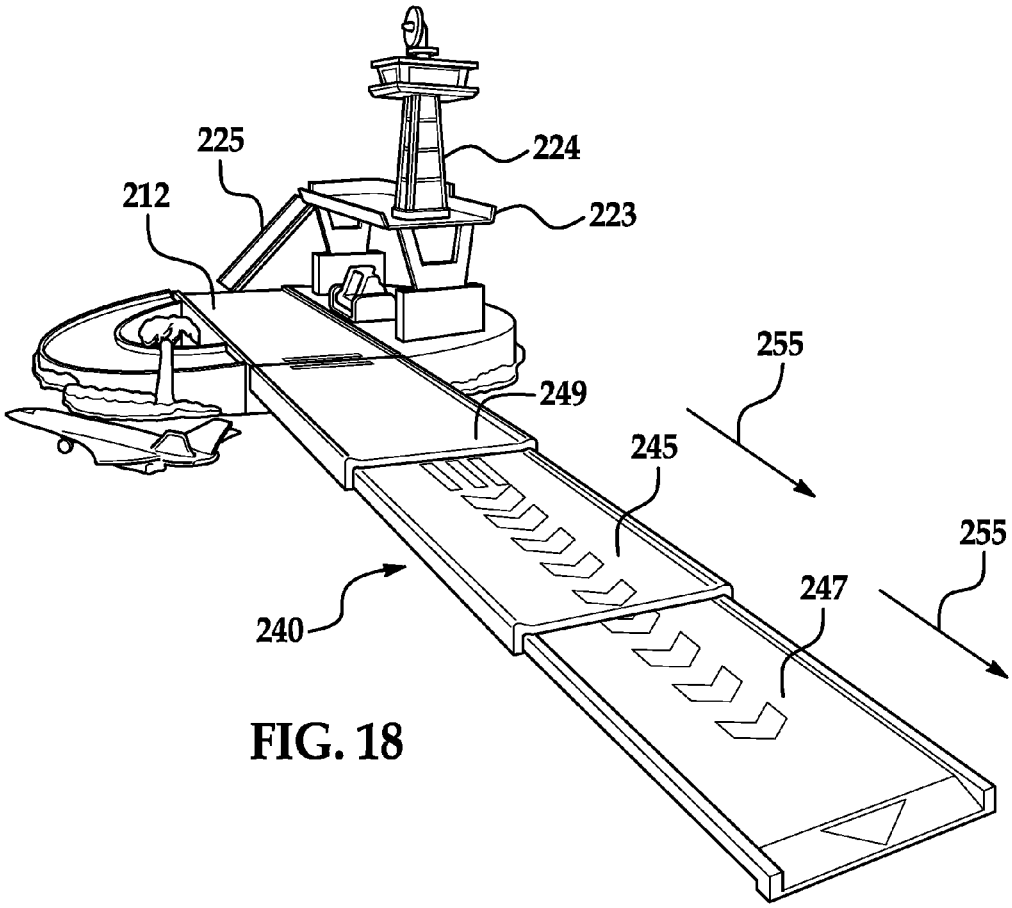

FIGS. 16-18 illustrate an exemplary embodiment of the present invention wherein the extendable feature is illustrated in various stages of an extended and a stowed position. As illustrated in FIG. 16 the landing strip is in a stowed position within the perimeter defined by section 212 and each telescoping section is retracted wherein first portion 249 is folded back upon section 212 or the surface defining landing strip 243 by rotating the same in the direction of arrow 251 such than an upper surface 253 of first portion 249 is positioned on top of the surface of section 212 defining landing strip 243 (see for example FIG. 16). In order to deploy extendable portion 240 and maximize the play area of play set 210, the first portion of extendable feature 240 is moved or rotated in a direction opposite to arrow 251 (see for example FIG. 17) wherein sections 245 and 247 are yet to be extended outwardly in the direction of arrows 255 and then sections 245 and 247 are extended to the position illustrated in FIG. 18. In one embodiment and in order to facilitate the pivotal or rotational movement of section 249 with respect to section 212 a hinge member 290 is located between section 249 and section 212. In one embodiment hinge member 290 provides a portion of the surface of surface area 243 and surface area 253 of sections 212 and 249 respectively when section 249 of the extendable feature is in the extended position illustrated in FIG. 17.

Although a preferred embodiment of this invention has been disclosed, one of ordinary skill in this art would recognize that certain modifications would come within the scope of this invention and it is not intended that these embodiments illustrate and describe all possible forms of the invention. Rather, the words used in the specification are words of description rather than limitation, and it is understood that various changes may be made without departing from the spirit and scope of the invention. For that reason, the following claims should be studied to determine the true scope and content of this invention. While the construction themed play set 10 and aviation themed play sets 110 and 210 are illustrated herein, it is fully contemplated according that any number of themes and ideas may be designed consistently with the present invention, without deviation from the teachings herein.

What is claimed is:

1. A play set comprising:

a main panel section having a first and second side lateral edge, and also having an upper main panel surface and a lower main panel surface;

a pair of side panel sections, each of which is pivotally connected to one of the first and second side lateral edges of the main panel section, and each also having a upper side surface and a lower side surface, the pair of side panel sections each being releasably attachable to each other;

wherein when the play set is in a first orientation, the main panel section and the pair of side panel sections are oriented generally co-planar to each other such that the upper main panel surface and upper side surfaces define a play surface having a perimeter, and wherein when the play set is in a second orientation, the pair of side panel sections are adjacent each other and in a plane parallel to the main panel section to define a play set case, and the upper main panel surface and upper side surfaces define an inner compartment of the play set case, and the pair of side panel sections are releasably attached to each other, further wherein in the first orientation, at least one of the main panel sections and the pair of side panel sections includes an elongated member extendable therefrom in a telescoping manner to define an additional play surface outside the perimeter of the main panel sections and side panel sections.

2. The play set as in claim 1 further comprising an upstanding member that is pivotably mounted such that it will fold down inside the case perimeter when moving from the first orientation to the second orientation.

3. The play set as in claim 2, wherein the upstanding member further comprises a first section and a second section, the first section being telescopingly secured to the second section.

4. The play set as in claim 1, wherein the elongated member can be fully retracted within the main panel section.

5. The play set as in claim 1, wherein each of the side panel sections has a raised platform with a ramp member pivotally secured thereto, wherein the ramp members are configured to define a bridge between the raised platforms.

6. The play set as in claim 1, wherein the main panel section and the pair of side panel sections can be folded up and closed into a compact case so that the first and second side lateral edges of the main panel section and the pair of side panel sections, are adjacent and generally parallel with each other along a plane.

7. The play set as in claim 6, wherein the main panel section has a carrying handle pivotally mounted to an edge of the main panel section.

8. The play set as in claim 1, wherein the main panel section and the pair of side panel sections can be folded up and closed into a compact case and a latch portion secures the pair of side panel sections together.

9. The play set as in claim 1 further comprising an upstanding member that is pivotally mounted at its lower end, an inwardly extending horizontal member movably mounted to the upstanding member, wherein a free end portion of the horizontal member includes a mounting portion which mates with a corresponding portion disposed on an underside of a toy vehicle and the upstanding member is rotatable and pivotable with respect to the play set and operates as a handle in order to lift and manipulate the horizontal member.

* * * * *